US006325254B1

(12) United States Patent
Diamond

(10) Patent No.: US 6,325,254 B1
(45) Date of Patent: Dec. 4, 2001

(54) FLUORINE SURFACE TREATING OF A BARRIER PISTON

(75) Inventor: George B. Diamond, Glen Gardner, NJ (US)

(73) Assignee: Dispensing Containers Corporation, NJ (US)

( * ) Notice: Subject to any disclaimer, the term of this patent is extended or adjusted under 35 U.S.C. 154(b) by 0 days.

(21) Appl. No.: 09/516,647

(22) Filed: Mar. 1, 2000

Related U.S. Application Data

(60) Provisional application No. 60/122,467, filed on Mar. 1, 1999.

(51) Int. Cl.[7] ..... B67D 5/42
(52) U.S. Cl. ..... 222/389; 222/386; 222/387
(58) Field of Search ..... 222/386, 387, 222/402.1, 389, 263; 277/945

(56) References Cited

U.S. PATENT DOCUMENTS 4,234,108 * 11/1980 Diamond ..... 222/386
4,877,156 * 10/1989 Clanet et al. ..... 222/286.5
5,779,107 * 7/1998 French ..... 222/386

* cited by examiner

*Primary Examiner*—Kevin Shaver
*Assistant Examiner*—Stephanie Willatt
(74) *Attorney, Agent, or Firm*—Ostrolenk, Faber, Gerb & Soffen, LLP

(57) ABSTRACT

In a barrier piston type fluent material dispensing container, for reducing permeation of the propellant which moves the barrier and dispenses the contents, past the piston and particularly past the flange surrounding the piston and sealing the piston in the container, the flange is of flexible plastic, typically of low density polyethylene, and the flange is surface treated with fluorine gas or other active fluorine compound which reduces the permeability of the flange to the bypassage of the propellant material, for increasing the shelf life of the can contents and eliminating contamination and deterioration thereof.

17 Claims, 1 Drawing Sheet

FLUORINE SURFACE TREATING OF A BARRIER PISTON

RELATED APPLICATIONS

This application is based on Provisional Application Ser. No. 60/122,467, filed Mar. 1, 1999 and entitled "FLUORINE SURFACE TREATMENT OF A BARRIER PISTON"

BACKGROUND OF THE INVENTION

The present invention relates to a pressurized dispensing container with a barrier piston between the dispensed material and the propellant and particularly relates to surface treating the permeable portions of the piston to resist penetration of hydrocarbons, compressed gases and the like propellants.

One form of pressurized container used for dispensing fluent material is a barrier or piston container which includes a dispensing nozzle at one end of the container, a barrier piston in the container separating the fluent, usually viscous dispensed material, which is at the valve side of the piston and a liquefied or gaseous propellant under pressure which is on the other side of the piston and which urges the piston toward the valve with sufficient force that when the valve is manually opened, the fluent material is forced through the valve by the propellant pressure applied to the piston.

A barrier may be any type of separating means within the container. One preferred barrier is a rigid piston which is supported and oriented in the container by the container wall and which is moved up the container wall toward the nozzle by the propellant pressure.

Cocking or tilting of the piston in the container should be prevented, since it will block expulsion of all of the dispensable material.

U.S. Pat. No. 4,234,108 discloses a barrier piston container, wherein the barrier piston is sealed to the internal wall of the container by a collar on the piston and by a flange from the collar which engages the container wall and wherein the piston is additionally prevented from cocking or tilting within the container by the presence of an anti-cocking flange around the bottom of the piston. These flanges are integral with the piston and slide along the wall of the container and are the contact regions between the piston and the container. In order to maintain the seal as the piston moves and to accommodate any slight deformities, dents, etc. in the can shape, the sealing flanges in particular are made of a low or medium density polyethylene plastic material or other suitable resilient plastic material. Low density polyethylene gives both the collar and the flange the flexibility required to allow them to be initially compressed radially when the piston is inserted into the can, e.g., through a reduced diameter neck of the can, and gives them the resiliency to cause the collar and flange to expand to their original cross sections so that they can seal in contact with the wall of the container after insertion and throughout movement of the piston along the container. There are slight changes in the diameter of the container due to changes in pressure in the can, e.g., as the piston moves and the propellant fills a greater volume chamber, the temperature to which the can is exposed, etc. Further, the material of the flanges compensates for dents or deformities by the material flexing around major dents and even by the flanges exerting sufficient force to at least partially reform the can and straighten dents, especially if the can is built of thin-walled material.

A flexible, polyethylene material collar and flange combination initially establishes and maintains the required seal.

But polyethylene is somewhat permeable to air, nitrogen, argon, carbon dioxide, nitrous oxide and other compressed gases used as propellants and is very permeable to hydrocarbon propellants and to hydrocarbons in general because polyethylene is itself a hydrocarbon.

Substituting a piston with collar and flange made from less flexible materials, including ABS plastic, nylon, polypropylene and similar plastics unfortunately gives the collar and flange combination insufficient flexibility to permit its initial contraction for insertion and its resilient expansion in order to seal in the can. If the piston is forced through a reduced diameter neck of a can, or is even inserted before the neck has been reduced, and if the flange and collar of the piston are reduced and their diameter is decreased by the wall of the can, then in order to ensure the seal with the can wall, the stiffness of the piston and flange makes sliding along the wall difficult due to wall irregularities. The piston may become stalled and not move along the full height of the container, so that the entire contents are not dispensed. As a result, the low density polyethylene or other suitable flexible plastic material should be used. But they have the permeability problem with respect to the propellants used.

When the flange and collar of the barrier piston are too permeable to the gaseous propellant material, it has caused problems. A flange and collar type piston of polyethylene generally cannot be used for dispensing shave gels and gel mousses, popular products normally dispensed by a barrier piston container, because of the permeation and the inherent qualities of the dispensed materials. Further, post-foam gels in particular, and aerosol barrier cans in general use much less VOC'S because only a few grains of liquefied propellant are used, and in many cases, only air is used to dispense products. Pistons for dispensing post-foam gels are made from ABS (acridonitrile butadiene styrene). Although nylon can be used, it is much more expensive. ABS plastic is too stiff to provide a flexible collar and flange combination on the piston. Therefore, a simple cylindrical piston which is smaller in diameter than the container is used and a layer of the dispensed produced itself forms the seal between the piston and the container wall. That type of seal is difficult to make, is also permeable and is subject to bypass when the container is not completely round or has become distorted or when insufficient material has been forced into the annular space between the piston and the container wall, which happens frequently in actual practice. The undesirable bypass and permeation causes the dispensed product to become aerated and to sputter and shoot out of the valve and also cause the product to leak past the piston and enter the propellant chamber below the piston.

When compressed gas is used as a propellant, as is done with caulks, cheeses and similar water-based products, the propellant gas permeates and destroys the quality of the product. In the case of nonwater-based products, such as greases, gas permeation is reduced. However, shelf life of the container filled with the material dispensed is reduced due to the residual gas permeation of the material.

SUMMARY OF THE INVENTION

It is an object of the present invention to provide a barrier piston container with an effective barrier that seals between the dispensed material and the gaseous propellant beneath the barrier, that seals against the wall of the container, that is not readily permeable, that avoids leakage past the barrier piston of either the propellant or the material being dispensed, that is easy to install in the container in the first instance, and that moves well along the container without becoming stalled.

According to the invention, the collar and flange which seal the piston to the container wall are of a low density polyethylene, a medium density polyethylene or other flexible plastic normally permeable to propellant gas. The plastic material is surface treated first by being exposed to fluorine gas or a fluorine derivative such as hydrofluoric acid, and that surface treatment makes the piston resistant to permeation either by hydrocarbons or by compressed gas propellants used in the barrier container, since the fluorine reacts with the double bonds in the polyethylene and seals the surface.

It is noted that commercial processes of producing bottles, tubes and other plastic containers that are filled with non-pressurized products are surface treated, e.g. with fluorine gas, which makes the containers impermeable to air and to volatile components present in the product and thus prevents their escape into the atmosphere. The present invention is a way to prevent the barrier piston within a pressurized container from being permeable to hydrocarbons or compressed gas and allows the piston to separate the product and the propellant to maintain a good seal with the container wall and to move along the container wall. The surface treatment of the flange permits the use of flexible plastic in a collar and flange system to be used for virtually all fluent products that are to be dispensed using a barrier piston container. Further, as permeation of the product and the propellant past the piston is greatly reduced, the potential shelf life for the filled container is significantly increased over one with a non-treated barrier piston.

It may be preferable to use the present invention where the gel or material to be dispensed contains a low boiling point hydrocarbon, such as pentane, isopentane, isobutane and other mixtures having a boiling point at about skin surface temperature. Examples of this are gellike shaving cream products which foam after being applied to the skin. The invention is useful with water-based products such as cheeses and other water-based food products.

Further the invention is preferably usable with propellants that include or consist of hydrocarbons or mixtures including hydro carbons or mixtures of hydrocarbons with other propellants as disclosed in U.S. Pat. No. 5,738,253.

In a further modification of the present invention, it has been found that providing a single collar and flange combination on the piston is sufficient for the sealing function. The second flange, typically positioned toward the bottom of the piston, is an anti-cocking flange. Need for such a flange can be eliminated by modifying the shape of the piston so that the piston itself has a greater diameter towards its base, e.g., by tapering the piston wall outwardly toward the bottom of the piston so that it is narrower at the top, where the sealing collar and flange are located, and wider at the bottom, where the piston itself performs the anti-cocking function. A piston so shaped and with an anti-cocking flange is easier to mold and form and still prevents the cocking.

Other features and advantages of the present invention will become apparent from the following description of the invention which refers to the accompanying drawings.

DESCRIPTION OF EMBODIMENTS

Figure 1:
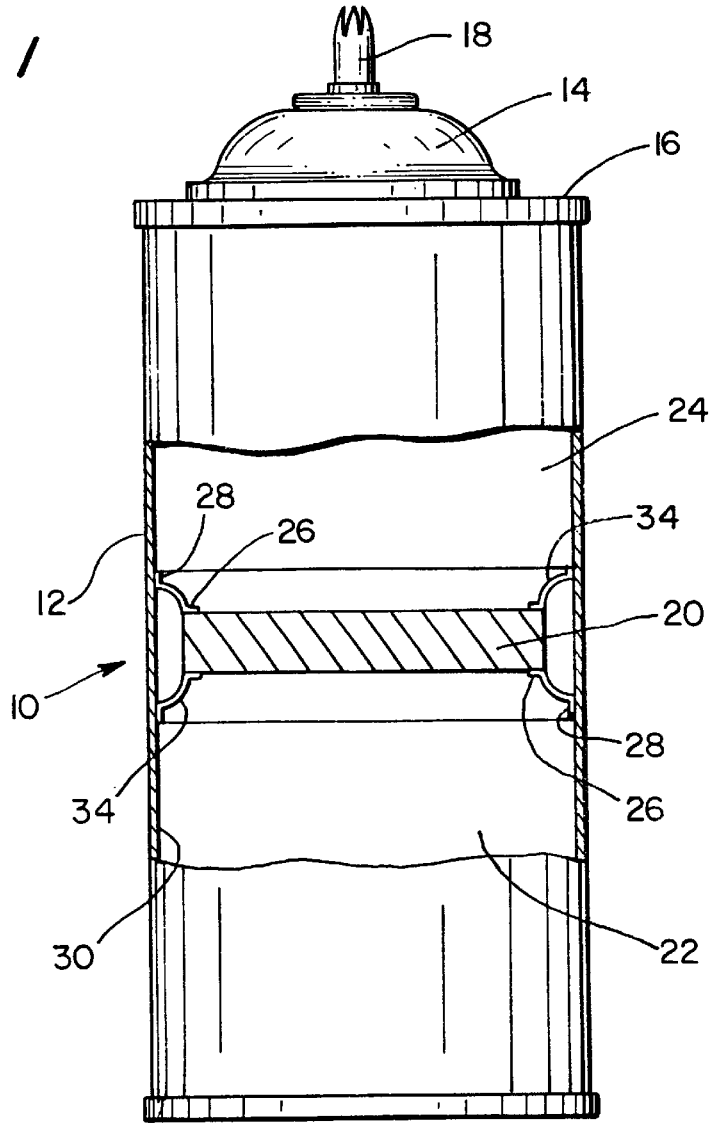
FIG. 1 shows a cross-section through a barrier piston dispensing container having a piston within it with sealing flanges and anti-cocking flanges.
Figure 2:
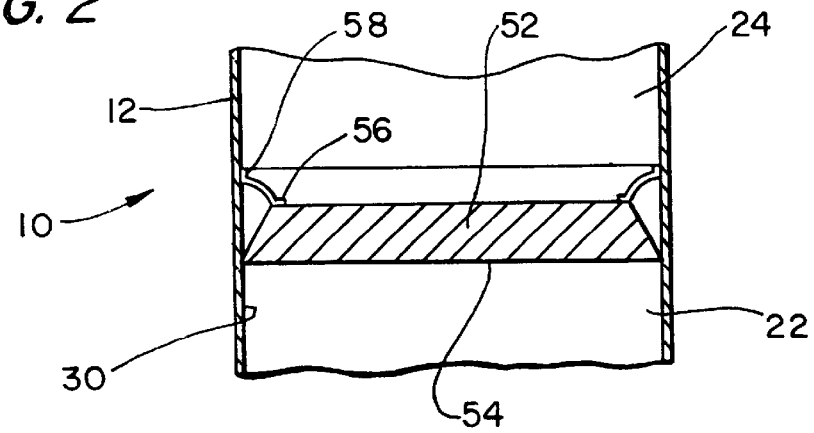
FIG. 2 shows a cross-section through a modified piston design which eliminates the anti-cocking flange.

FIG. 1 shows a barrier piston container 10, e.g., of the type shown in U.S. Pat. No. 4,234,108. The container 10 is a conventional container, e.g., an aluminum or steel, drawn and ironed can 12 with a dome 14 seamed to the container at 16. The dome includes a conventional fluent material dispensing tip valve 18 at the top which is normally sealed and is manually operated to open to dispense the fluent material.

Within the can is disposed a barrier piston 20, which divides the can into a propellant container chamber 22 beneath the piston and a dispensed material chamber 24 above the piston. The can is loaded by depositing propellant in the chamber 22, positioning the piston 20 in the container with the volume of the chamber 22 minimized, loading dispensable material in the chamber 24 above the piston 20 and applying the dome 14. As the valve 18 is manipulated to be opened, the fluent dispensable material in the chamber 24 is enabled to exit through the valve and the propellant in the chamber 22 forces the piston 20 upwardly to push the material in the chamber 24 out the valve 18. Sufficient propellant is provided in the chamber 22 to move the piston all the way to the top of the container 12 and dispense a maximum amount of the contents from the chamber 24.

As there is a danger of leakage of the pressurized propellant past the piston into the chamber 24 or of permeation of material in the chamber 24 down into the propellant chamber 22, with the resultant drawbacks discussed above, the piston 20 is provided with an upper, annular sealing collar and flange combination 26, 28 which is directed toward and contacts the interior surface 30 of the container wall 12. The collar and flange are shaped to continuously contact the surface 30 around the container. The material of the collar and flange might be low density polyethylene. The collar and flange are so molded and shaped and their material is so flexible and resilient that the flange is normally urged into contact with the container wall 30 throughout movement of the piston along the container 30.

The piston has only short height in the container. Contact between the collar and flange 26, 28 and the container wall 30 is not sufficient to prevent the piston 20 from possibly cocking. As a result, on the other bottom end of the piston there is an anti-cocking flange 34 which also engages the interior wall 30. With two separated circles of contact between the flanges and the wall 30, the piston 20 is prevented from cocking.

Both of the flange 34 and the collar and flange 26, 28 are made of a permeable low density polyethylene, for example. To prevent permeation, according to the invention, the piston with the flange and collar combination 26, 28 and 34 is first surface treated in a chamber of fluorine gas or other fluorine product for an adequate period of time. The inventor hereof sends the pistons to a third party named Fluoro-Seal Inc. of Houston, Tex. who exposes the pistons to hydrogen fluoride gas in a proprietary trade secret process under the trademark FLUORO-SEAL, which is not published and details of which are not provided to the public or to their customers, including the inventors. The exposure of the plastic to the fluorine gas so changes the character of the piston material that the material is no longer permeable to a propellant, such as a hydrocarbon propellant or a normal gaseous propellant. The flanges assure the mechanical separation of the propellant and the fluent material so that they do not mix. The fluorine gas treatment does not significantly alter the other important physical characteristic of the polyethylene collar and flange, namely, their flexibility and resilient engagement with the interior surface 30 of the container wall.

In place of the anti-cocking flange 34 provided in the conventional barrier piston container (modified by surface treatment of the piston), the piston 50 may be of modified design, tapering from a narrower upper end toward the fluent material chamber 24 to the wider bottom end 54 toward the propellant chamber 22. The piston is generally frustoconical. At the relatively slightly narrower top end 52, there is a sealing collar and flange 56, 58, corresponding in the form, material and surface treatment to the above described piston, collar and flange combination 26, 28. However, at the bottom end 54 of the piston 50, there is no need for an anti-cocking flange 34, as FIG. 1, because the piston itself is of greater cross section and diameter at its bottom. The bottom edge 62 of the piston, is an adequate anti-cocking guide for the piston, preventing the piston from tilting or cocking in the container as the piston is moved up toward the nozzle.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A barrier piston type fluent material dispensing container, comprising:

a container having an internal side wall and having an end with an openable nozzle thereon;

a barrier piston disposed in the container for separating the container between a fluent material containing and dispensing chamber at one side of the piston and toward the end of the container with the nozzle and a gaseous propellant containing chamber in the container at the opposite side of the piston; the piston being movable along the container side wall under the propellant pressure;

a flange extending around the piston, the flange being so shaped and of such material as to being resiliently biased against the internal wall of the container and to retain that contact with the internal wall of the container as the piston is moved up along the container by the pressure in the propellant chamber;

at least the flange of the piston being fabricated of a material which normally would permit permeation of gaseous propellant material through the flange and the flange being of the material, which is surface treated by fluorine to reduce its permeability.

2. The container of claim 1, wherein the flange is comprised of polyethylene.

3. The container of claim 2, wherein the flange is comprised of low density polyethylene.

4. The container of claim 2, wherein the flange is comprised of medium density polyethylene.

5. The container of claim 3, wherein the propellant material disposed in the container below the piston is a hydrocarbon propellant.

6. The container of claim 3, wherein the propellant chamber of the container is a compressed gas propellant.

7. The container of claim 3, wherein the propellant material disposed in the container below the piston is a mixture of various propellants.

8. The container of claim 3, wherein the material being dispensed is a water-based material.

9. The container of claim 3, wherein the flange is at the side of the piston toward the fluent material containing chamber.

10. The container of claim 1, further comprising an additional anti-cocking flange formed around the piston at the side of the piston toward the propellant containing chamber and the anti-cocking flange being shaped to contact the interior wall of the container at a location spaced away from the contact between the sealing flange and the container wall.

11. The container of claim 1, further comprising a collar around the piston at the side of the piston toward the dispensed material chamber and the flange being supported and defined on the collar.

12. The container of claim 11, further comprising an additional anti-cocking flange formed around the piston at the side of the piston toward the propellant containing chamber and the anti-cocking flange being shaped to contact the interior wall of the container at a location spaced away from the contact between the sealing flange and the container wall.

13. A method of forming a barrier piston for a use as the barrier piston container, comprising molding the barrier piston with a flange around the periphery thereof, wherein the flange is of resilient material;

having at least the flange of the piston surface treated in gaseous fluorine for reducing the permeability of the flange to the bypass of hydrocarbon propellants or compressed gas propellants.

14. The method of claim 13, wherein at least the flange of the piston is initially formed of polyethylene.

15. The method of claim 13, wherein the flange is formed of low density polyethylene.

16. The method of claim 13, further comprising installing the piston in the container, wherein the container and the piston flange are so shaped that the flange is normally self-biased resiliently against the internal wall of the container;

loading material to be dispensed in the container above the piston; closing the container with a valve above the dispensed material; and placing the propellant through a sealable hole in the container-bottom and sealing the hole.

17. The method of claim 13, wherein the flange of resilient material is a first flange, the method further comprising molding an anti-cocking flange on the piston spaced away from the first flange and positioned so that the first flange and the anti-cocking flange will contact the interior wall of the container at spaced apart locations for preventing the piston from cocking in the container.

* * * * *